United States Patent [19]

Vukelic

[11] 4,151,004

[45] Apr. 24, 1979

[54] SUGARCANE PROCESSING EQUIPMENT

[76] Inventor: Branko Vukelic, 740 Kennedy Dr. W., Windsor, Ontario, Canada

[21] Appl. No.: 843,143

[22] Filed: Oct. 17, 1977

[30] Foreign Application Priority Data

Dec. 10, 1976 [CA] Canada ..... 267626

[51] Int. Cl.[2] ..... C13C 1/02; C13C 1/04; C13C 1/08

[52] U.S. Cl. ..... 127/2; 83/168; 99/588; 130/30 R; 130/31 R

[58] Field of Search ..... 99/538, 539, 540, 543, 99/558, 574, 576, 567, 547, 584, 585, 587; 426/489; 127/2; 83/168; 130/30 R, 30 G, 31 R, 31 A

[56] References Cited

U.S. PATENT DOCUMENTS

| | | | |
|---|---|---|---|
| 2,606,578 | 8/1952 | Irwin | 83/168 |
| 2,829,653 | 4/1958 | Rush | 130/30 G |
| 3,567,510 | 12/1967 | Tilby | 127/2 |
| 4,003,276 | 1/1977 | Schmitt | 83/168 X |

FOREIGN PATENT DOCUMENTS

| | | |
|---|---|---|
| 2414903 | 10/1975 | Fed. Rep. of Germany. |
| 1295479 | 8/1970 | U.S.S.R. |

*Primary Examiner*—Sidney Marantz
*Attorney, Agent, or Firm*—James R. Hughes

[57] ABSTRACT

A sugarcane pith and rind separation unit comprising a power driven rind gripping roll, a power driven pith milling roll in close spaced relation, said rolls having surface indentation and being driven at such rotational speeds so as to accept incoming longitudinally split sugarcane stalk halves, flatten them, and mill out the pith away from the rind, and a pith deflecting plate or shroud positioned at the output of the two rolls, said plate having shaped surfaces for causing the rind and pith to travel further on separate paths and having, adjacent the leading edge and closely positioned in the output side of the pinch between the rolls, an elongated cylindrical roller of relatively small diameter and adapted to be driven at a rotational speed such as to effectively move any fibrous material that might cause clogging and binding out of the confined region between the rolls and the deflecting plate and pass to the output. In the preferred embodiment, the roller has formed on its surface, a series of elongated grooves defining sharp gear-like teeth inclined in the rotation direction and effective to cut, shred, break-up, and move the said fibrous material.

5 Claims, 8 Drawing Figures

SUGARCANE PROCESSING EQUIPMENT

This invention relates to an apparatus for separating the pith and rind components of sugarcane stalk and more particularly to an improvement to such apparatus to prevent clogging, binding, and improper operation.

The conventional method of extracting the sugar-containing juices from sugarcane used for many years has been to cut up to stalks and to pass these in generally random orientation through high pressure rollers that squeeze out the juice. In recent years a different method has been developed and this is described in, among others, Canadian Pat. No. 887,978 issued Dec. 14, 1971 to Sydney E. Tilby. In this method the sugarcane stalks are individually sliced in half longitudinally, the two halves are flattened, with the pith which contains the sugar juices being milled from the flattened rind. The rind portion is separately passed onward for further treatment operation and its projected uses. The separated pith is passed onwards to sugar extraction process steps or to its projected use which may include use as a livestock feed. The means for flattening and removing the pith from the rind includes two closely spaced rolls through which the cane half passes and these are a pith milling roll and rind gripping roll. A pith deflecting shroud in the form of a sharp edged, shaped plate is positioned in spaced relation to and in close proximity to the output side of the two rolls.

Considerable difficulty has been encountered in operation with the pith-deflecting plate in that the sharpened leading edge that must be positioned closely to the rolls in the output pinch soon loses its sharpness and thus its efficiency. The spacing between the two rolls and the pith deflecting plate are relatively critical and generally close. As a result, there is a great tendency for fibrous material contained in the pith as well as in the rind to become lodged on and over the plate clogging the space and reducing effective separation operation. The removal of this material is not easy and the apparatus has to be shut down to do this. The fibrous material from the pith contains a certain amount of juice making it sticky and causing it to more readily adhere to the plate leading edge resulting in binding and clogging.

It is an object of the present invention to provide an apparatus for sugarcane pith and rind separation of the type having a gripping roll and a pith milling roll followed by a pith deflecting plate that reduces or eliminates the problem of clogging and binding in the space between rolls and the leading edge of the plate.

This and other objects of the invention are achieved by a sugarcane pith and rind separation unit comprising a power driven rind gripping roll, a power driven pith milling roll in close spaced relation, said rolls having surface indentation and being driven at such rotational speeds as to accept incoming longitudinally split sugarcane stalk halves, flatten them, and mill out the pith away from the rind, and a pith deflecting plate or shroud positioned at the output of the two rolls, said plate having shaped surfaces for causing the rind and pith to travel further on separate paths and having, adjacent the leading edge and closely positioned in the output side of the pinch between the rolls, an elongated cylindrical roller of relatively small diameter and adapted to be driven at a rotational speed such as to effectively move any fibrous material that might cause clogging and binding out of the confined region between the rolls and the deflecting plate and pass to the output. In the preferred embodiment, the roller has formed on its surface, a series of elongated grooves defining sharp gear-like teeth inclined in the rotation direction and effective to cut, shred, break-up, and move the said fibrous material.

In drawings which illustrate embodiments of the invention,

Figure 1:
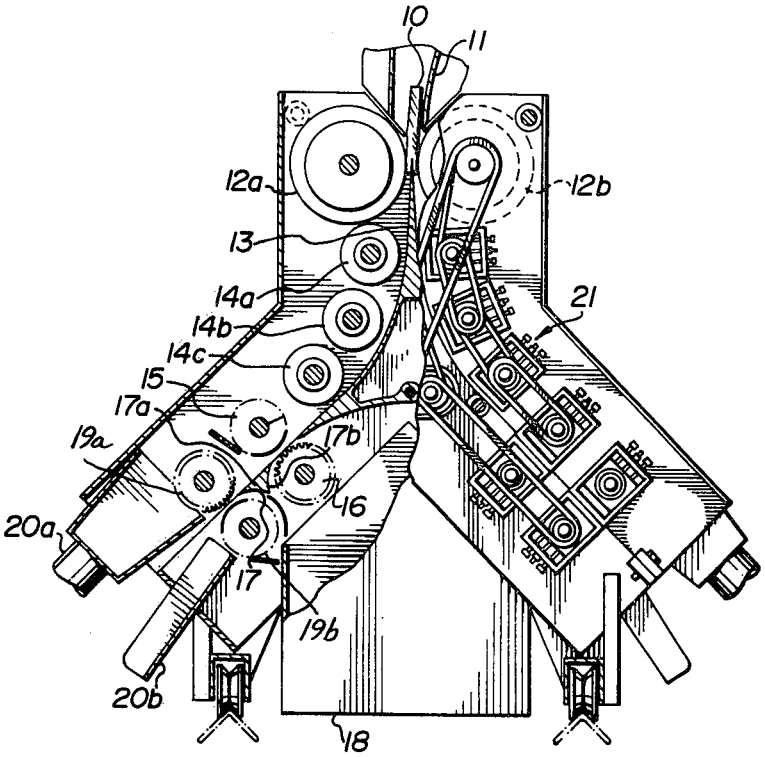
FIG. 1 PRIOR ART
FIG. 1 is a view, partly in section, of a known type of sugarcane pith and rind separator.
Figure 2:
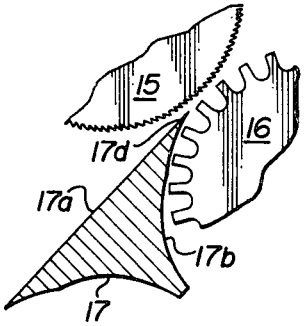
FIG. 2 PRIOR ART
FIG. 2 is a cross sectional view of the rind gripping and pith milling rolls of FIG. 1.

Referring to FIG. 1, a known type of sugarcane pith-rind-epidermis separator of the type disclosed in the above mentioned Canadian Pat. No. 887,978 is shown. A sugarcane stalk 10 entering by chute 11 is grasped by rollers **12*a* and 12*b* and forced past sharp knife blade 13 which slices it longitudinally in half with one half going left and the other right. The stalk half is moved along by rollers 14*a*, 14*b*, and 14*c* into the pinch of rind gripping roll 15 and pith milling roll 16 which tend to flatten the stalk half. At the same time, the milling roll which has deep teeth and is powered to rotate faster than the gripping roll, mills out the pith which is moved past surface 17*b* of pith deflecting plate or shroud 17 and sent to output chute 18. The flattened rind portion is propelled along surface 17*a* of plate 17 to rolls 19*a* and 19*b* which operate to remove the epidermis layer from the rind layer and pass these to outputs 20*a* and 20*b*. The various rolls are driven at appropriately chosen speeds from a power source (not shown) by a link belt drive system shown generally at 21**.

The operation of gripping roll 15, pith milling roll 16, and deflecting plate 17 which must be positioned close to roll 16 and close up in the pinch between rolls, has a sharp leading edge **17*d***. Difficulties due to the binding and clogging of fibrous material in the region have been met with resulting in poor operation of the apparatus.

Figure 3:
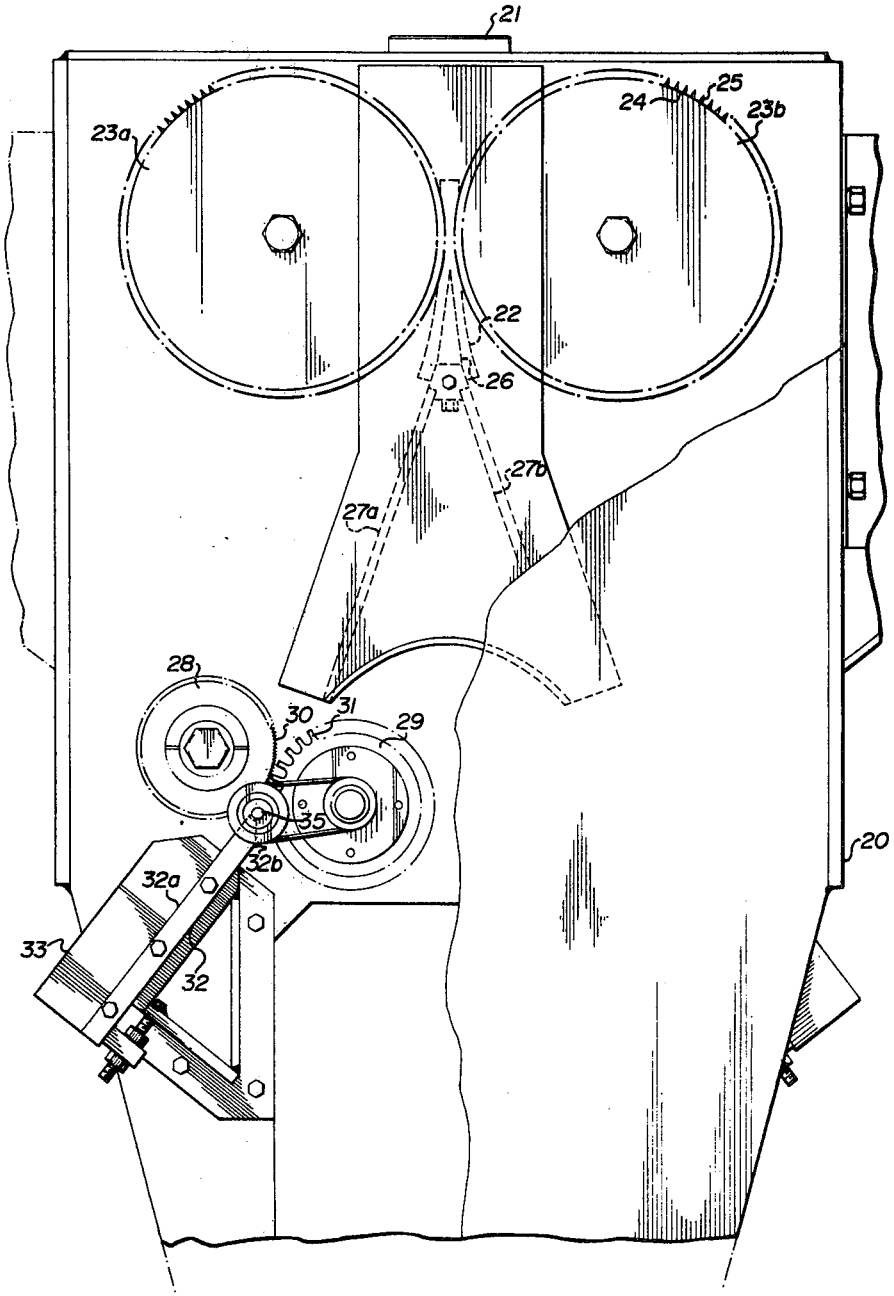
FIG. 3 is a view partly in section, of a pith-rind separator showing deflector plate with clearing rollers rotating deflector.
Figure 4:
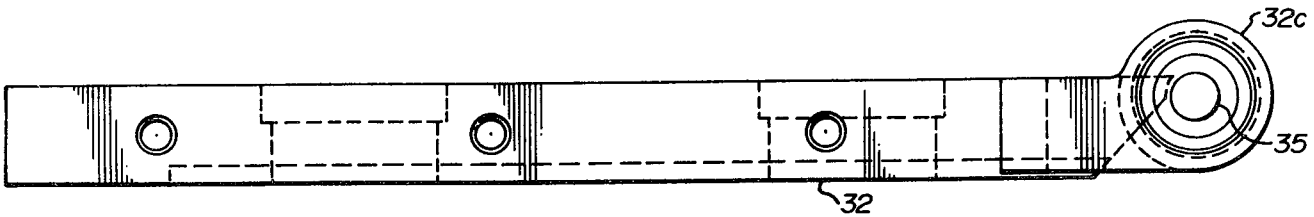
FIG. 4 is a cross section of the deflector plate and rotating deflector.

Referring to FIG. 3, a sugarcane pith-rind separator is shown with a rotating deflector and deflecting plate according to the invention incorporated. This includes a structural frame shown generally as 20 on which is mounted the various chutes, rolls, driving mechanisms for the rolls, etc. The incoming sugarcane stalk length is fed in at input chute 21 either manually or from some form of conveying and aligning system (not shown). The stalk 22 is grasped between rolls **23*a* and 23*b* which have a resilient surface 24 with spikes 25 mounted thereon and forced past knife 26 which slice the stalk longitudinally sending one half along chute surface 27*a* and the other along chute surface 27*b*. The rolls should have a surface, a rotation speed, and be positioned such that the stalk is driven through the knife but not crushed or flattened. From this point the two sides of the apparatus operate identically. The stalk half passing down chute 27*a* is fed into the pinch between gripping roll 28** and pith milling roll 29 which flatten it and mill out the pith from the rind. The gripping roll has a serrated surface 30 for gripping the rind and the milling roll has deeply indented teeth 31 for cutting into the pith and milling it away. At the output side of the two rolls is adjustably mounted a deflecting plate 32 which has its leading edge positioned into the exit pinch of the rolls. The flattened rind portion of the stalk passes along the upper surface 32*a* of the plate through chute 33 to the output. The pith portion milled from the rind passes along the opposite surface 32*b* of the deflecting plate to its output.

Figure 5:
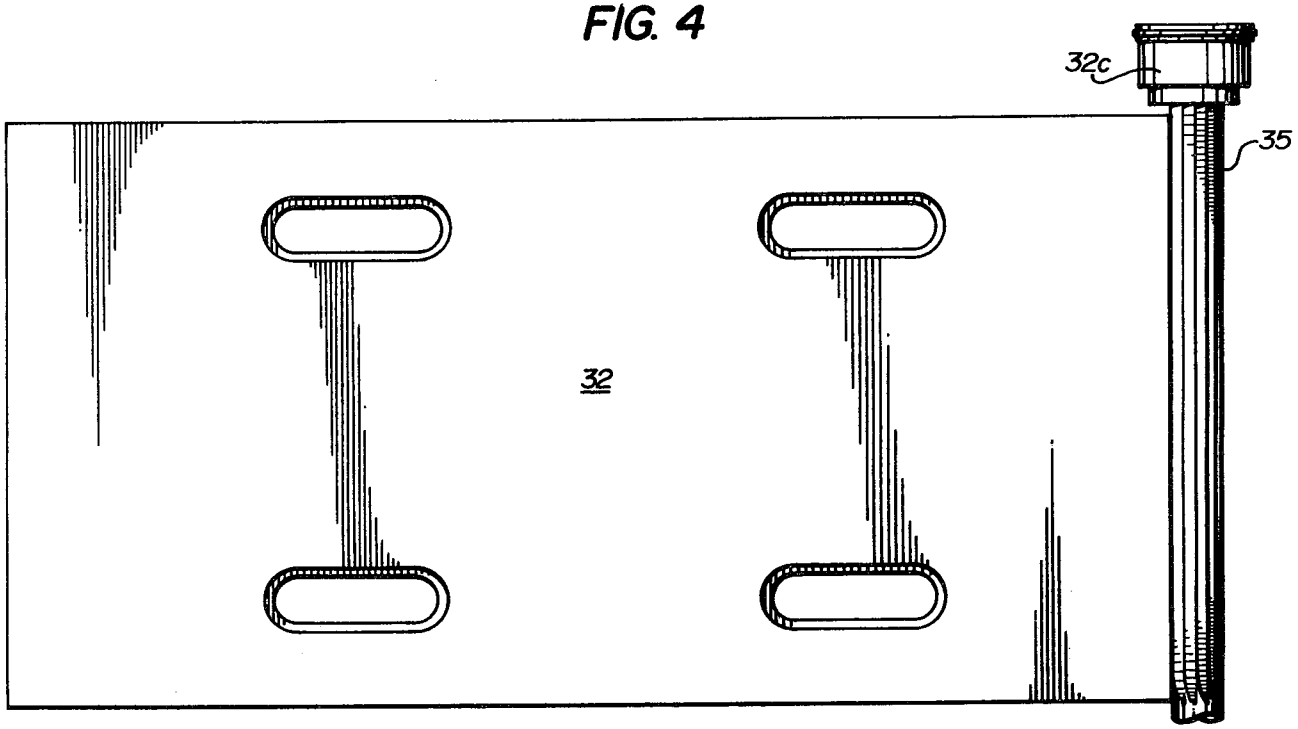
FIG. 5 is a plan view of the deflector plate and rotating deflector.
Figure 6:
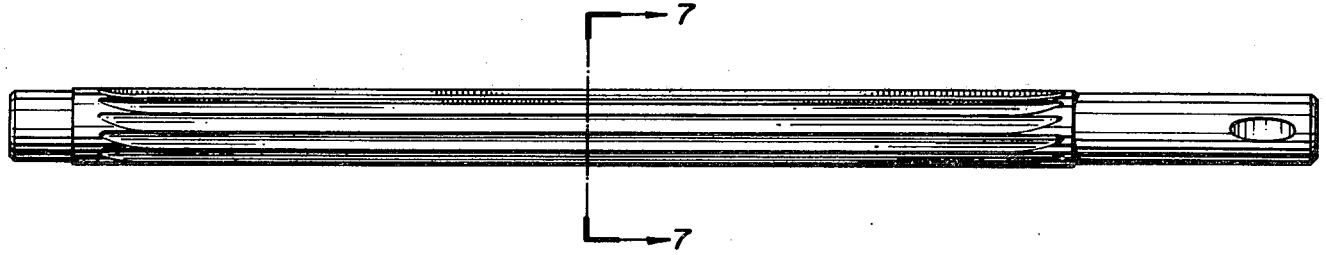
FIG. 6 is a longitudinal cross-section of the preferred type of rotating deflector.

Mounted adjacent the leading edge of plate 32 is a cylindrical deflecting roller 35 which has a series of teeth or grooves 35*a* cut in its surface. The teeth are slanted or projected in the rotation direction and are effective to deflect the rind and the pith in the correct paths and to cut, break-up, or remove fibrous material that might otherwise get caught at the leading edge of the deflector plate and cause clogging and binding. FIGS. 5 and 6 illustrate the plate and deflector roller more clearly. It will be noticed that the roller is mounted such that a small portion lies above the plane of the upper surface 32*a* of plate 32. The roller (rotating deflector) is mounted in suitable bushings 32*c* attached to the deflector plate and is connected to a drive that rotates it in the direction shown. Typical rotation speeds for rolls 23*a* and 23*b* is 600 RPM; for roll 28 it is 1100 RPM; for roll 29 it is 3000 RPM; and for deflector roller 35 it is 3600 RPM.

Figure 7:
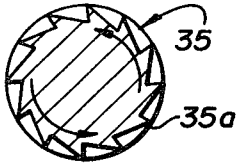
FIG. 7 is a transverse cross-section of the deflector.
Figure 8:
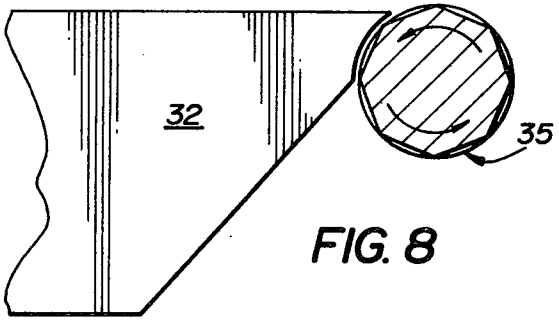
FIG. 8 is a cross-section of an alternative form of roller.

FIGS. 6 and 7 are longitudinal and transverse cross-sections of roller 35. In the preferred version, the teeth 35*a* are sharp and inclined in the direction of rotation. A non-grooved or toothed device would give some useful effect and a polygonal roller, e.g. an octogonal cross-section as shown in FIG. 8 would give very good results. The rotating deflector would preferably be made of hard metal, e.g. steel, although a hard plastic might also be used.

In the above description, the invention is shown as applied to a specific type of sugarcane pith-rind separator, i.e. apparatus for producing pith material for livestock feed and rind for building materials but it will be realized that it can be applied to all forms of separators in general of the type that splits the stalk longitudinally and mills out the pith.

I claim:

1. A sugarcane pith and rind separation unit comprising:

(a) a power driven rind gripping roll;

(b) a power driven pith milling roll positioned in close parallel spaced relation to the rind gripping roll;

(c) said rolls having surface indentations and being adapted to be driven at such rotational speeds as to accept incoming longitudinally split sugarcane stalk halves, flatten them, and mill out the pith away from the rind;

(d) a pith deflecting plate having surface for causing the rind and the separated pith to travel further on separate paths; and (e) a rotating deflector in the form of an elongated cylindrical roller of relatively small diameter positioned adjacent the leading edge of the said plate and closely in the output side of the pinch between the said rolls and adapted to be driven at a rotational speed in relation to the said rolls such as to move any fibrous material that might otherwise collect and cause clogging and binding out of the confined region between the rolls and the deflecting plate and pass to the output.

2. A separation unit as in claim 1 wherein the cylindrical roller has a series of longitudinal grooves formed in its surface.

3. A separation unit as in claim 2 wherein the grooves define generally sharp teeth, said teeth being slanted or inclined in the direction of rotation of the rollers.

4. A separator unit as in claim 1 wherein the roller has a polygonal cross-section.

5. A separator unit as in claim 1, wherein the roller is connected to a drive system to be rotated in the same direction as the pith milling roll.

* * * * *